US008109198B2

(12) United States Patent
Matsuzaki et al.

(10) Patent No.: US 8,109,198 B2
(45) Date of Patent: Feb. 7, 2012

(54) HYDRAULIC CONTROL APPARATUS

(75) Inventors: Takeharu Matsuzaki, Kariya (JP); Shigeto Nakajima, Nagano (JP); Takeshi Kobayashi, Nagano (JP)

(73) Assignees: Kabushiki Kaisha Toyota Jidoshokki, Aichi-ken (JP); Nishina Industrial Co., Ltd, Nagano-Ken (JP)

( * ) Notice: Subject to any disclaimer, the term of this patent is extended or adjusted under 35 U.S.C. 154(b) by 918 days.

(21) Appl. No.: 12/086,042

(22) PCT Filed: Mar. 26, 2007

(86) PCT No.: PCT/JP2007/057319
§ 371 (c)(1),
(2), (4) Date: Jun. 3, 2008

(87) PCT Pub. No.: WO2007/116846
PCT Pub. Date: Oct. 18, 2007

(65) Prior Publication Data

US 2009/0242050 A1 Oct. 1, 2009

(30) Foreign Application Priority Data

Mar. 27, 2006 (JP) ..... 2006-085209

(51) Int. Cl.
*F16K 11/07* (2006.01)

(52) U.S. Cl. ..... 91/447; 91/445

(58) Field of Classification Search ..... 91/445, 91/447

See application file for complete search history.

(56) References Cited

U.S. PATENT DOCUMENTS 3,980,000 A * 9/1976 Iijima et al. ..... 91/514
4,066,006 A * 1/1978 Heiser ..... 91/433
4,716,929 A * 1/1988 Tomer ..... 137/505.13

(Continued)

FOREIGN PATENT DOCUMENTS

DE 198 04 398 A1 8/1999

(Continued)

OTHER PUBLICATIONS

International Search Report for the corresponding PCT application No. PCT/JP2007/057319, mailed on Jul. 20, 2007.

*Primary Examiner* — John Rivell
*Assistant Examiner* — Ian Paquette
(74) *Attorney, Agent, or Firm* — Locke Lord LLP

(57) ABSTRACT

A hydraulic control apparatus 1 includes a switch valve 11, a valve support chamber 35, a flow control valve 12 movable within the valve support chamber 35, an on-off valve 13 movable within the communication path chamber 12*a*, and a valve control device 14. The flow control valve 12 has a communication path chamber 12*a* and a back pressure chamber 12*d*. The on-off valve 13 is capable of opening and shutting off a communication path X between a cylinder line 32 and a switch valve line 33. A restrictor is formed between the flow control valve 12 and a wall defining the valve support chamber 35. The restrictor connects the cylinder line 32 and the communication path chamber 12*a* to each other. The opening degree of the restrictor is changed in correspondence with movement of the flow control valve 12. When the switch valve 11 is located at the neutral position or the supply position, the valve control device 14 applies a fluid pressure in the cylinder line 32 to the back pressure chamber 12*d* for urging the on-off valve 13 in a direction for shutting off the communication path 12*a*. When the switch valve 11 is located at the drainage position, the valve control device 14 applies a pilot pressure lower than the fluid pressure in the cylinder line 32 to the back pressure chamber 12*d*, thereby moving the on-off valve 13 in a direction for opening the communication path X.

20 Claims, 7 Drawing Sheets

U.S. PATENT DOCUMENTS

| | | | | |
|---|---|---|---|---|
| 4,955,461 | A * | 9/1990 | Keir | 187/234 |
| 5,048,395 | A | 9/1991 | Ohshima | |
| 5,273,069 | A * | 12/1993 | Akiyama et al. | 137/596 |
| 5,613,519 | A * | 3/1997 | Ishizaki | 137/596.2 |
| 6,125,970 | A * | 10/2000 | Takeuchi et al. | 187/223 |
| 6,164,415 | A * | 12/2000 | Takeuchi et al. | 187/224 |
| 6,389,809 | B1 * | 5/2002 | Niidome et al. | 60/443 |
| 6,695,567 | B2 | 2/2004 | Nagata et al. | |
| 7,080,663 | B2 * | 7/2006 | Kauss et al. | 137/625.66 |
| 7,650,907 | B2 * | 1/2010 | Goto et al. | 137/625.69 |
| 7,913,612 | B2 * | 3/2011 | Oosima | 91/447 |
| 2009/0282825 | A1 * | 11/2009 | Oosima | 60/459 |

FOREIGN PATENT DOCUMENTS

| | | | |
|---|---|---|---|
| DE | 19955524 | A1 | 5/2001 |
| EP | 1 643 138 | A1 | 4/2006 |
| JP | 8-159105 | | 6/1996 |
| JP | 2000-179504 | | 6/2000 |
| JP | 2002-237706 | | 11/2002 |
| JP | 2005-145670 | | 6/2005 |
| TW | 553888 | B | 9/2003 |
| WO | WO 99/35407 | | 7/1999 |
| WO | WO 2006/049344 | A1 | 5/2006 |

* cited by examiner

HYDRAULIC CONTROL APPARATUS

FIELD OF THE INVENTION

The present invention relates to hydraulic control apparatuses having switch valves for controlling supply and drainage of fluid to cylinders.

BACKGROUND OF THE INVENTION

As a hydraulic control apparatus having a switch valve for controlling supply and drainage of fluid to and from a cylinder, a hydraulic control apparatus used in, for example, a forklift is known. The hydraulic control apparatus may be employed for actuating a lift cylinder of the forklift, which selectively raises and lowers a fork, as described in Japanese Laid-Open Patent Publication No. 2002-327706.

The hydraulic control apparatus of the publication includes an operated check valve and a flow regulator provided in a main passage. The main passage connects a lift control valve, which is operated by means of a lift lever, to the lift cylinder. The lift control valve has a spool that includes a variable restrictor and is switched among a raising position, a neutral position, and a lowering position. More specifically, when the spool is located at the neutral position or the raising position, the lift control valve seals a back pressure chamber of the operated check valve. The operated check valve is thus urged in a direction for blocking the main passage. Meanwhile, a pump operates to apply hydraulic pressure to a second pressure chamber of the flow regulator and a valve body of the flow regulator is maintained at a fully open position.

In contrast, when the spool is located at the lowering position, a tank operates to apply hydraulic pressure to the back pressure chamber of the operated check valve. The operated check valve thus opens the main passage using the hydraulic pressure generated by the lift cylinder. Meanwhile, the hydraulic pressure in the tank is supplied to the second pressure chamber of the flow regulator. This causes the valve body of the flow regulator to move in such a manner that the difference between the pressure in a portion upstream from the variable restrictor and the pressure in a downstream portion is maintained equal to or lower than a predetermined value. The flow rate of the hydraulic oil flowing from the lift cylinder is thus adjusted.

However, in the hydraulic control apparatus, the operated check valve and the flow regulator are formed separately. Besides, the hydraulic control apparatus includes a large number of components and thus has a relatively complicated configuration. Further, since the operated check valve and the flow regulator must be accommodated separately in two different spaces, the hydraulic control apparatus becomes relatively large.

SUMMARY OF THE INVENTION

Accordingly, it is an objective of the present invention to provide a compact hydraulic control apparatus that stably performs shutting operation.

To achieve the foregoing objective and in accordance with one aspect of the present invention, a hydraulic control apparatus for a cylinder is provided. The apparatus includes a switch valve, a cylinder line, a switch valve line, a valve support chamber, a flow control valve, an on-off valve and a valve control device. The switch valve controls supply and drainage of a fluid with respect to the cylinder. The switch valve is switched among a supply position for supplying the fluid to the cylinder, a drainage position for draining the fluid from the cylinder, and a neutral position for preventing the supply and the drainage of the fluid with respect to the cylinder. The cylinder line is connected to the cylinder. The switch valve line is connected to the switch valve. The valve support chamber is arranged between the cylinder line and the switch valve line. The valve support chamber has a cylinder side opening communicating with the cylinder line and a switch valve side opening communicating with the switch valve line. The flow control valve is movably located in the valve support chamber. The flow control valve selectively connects and disconnects the cylinder line and the switch valve line with respect to each other. The flow control valve includes a communication path chamber. The flow control valve has a cylinder side through hole that connects the communication path chamber with the cylinder side opening and a switch valve side through hole that connects the communication path chamber with the switch valve side opening. The on-off valve is movably located in the communication path chamber. The on-off valve defines a back pressure chamber in the communication path chamber. A fluid pressure acting on the on-off valve is introduced into the back pressure chamber. The on-off valve selectively opens and shuts off a communication path between the cylinder line and the switch valve line. The valve control device controls operation of the flow control valve and the on-off valve. A restrictor is formed between the flow control valve and a wall defining the valve support chamber. The restrictor connects the cylinder line and the communication path chamber to each other. An opening degree of the restrictor is changed in correspondence with movement of the flow control valve. When the switch valve is located at the neutral position or the supply position, the valve control device applies a fluid pressure in the cylinder line to the back pressure chamber for urging the on-off valve in a direction for shutting off the communication path. When the switch valve is located at the drainage position, the valve control device applies a pilot pressure lower than the fluid pressure in the cylinder line to the back pressure chamber, thereby moving the on-off valve in a direction for opening the communication path.

In accordance with another aspect of the present invention, another hydraulic control apparatus for a cylinder is provided. The hydraulic control apparatus includes a switch valve, a cylinder line, a switch valve line, a valve support chamber, a flow control valve, and an on-off valve and a valve device. The switch valve controls supply and drainage of a fluid with respect to the cylinder. The switch valve is switched among a supply position for supplying the fluid to the cylinder, a drainage position for draining the fluid from the cylinder, and a neutral position for preventing the supply and the drainage of the fluid with respect to the cylinder. The cylinder line is connected to the cylinder. The switch valve line is connected to the switch valve. The valve support chamber is arranged between the cylinder line and the switch valve line. The flow control valve is movably located in the valve support chamber. The flow control valve selectively connects and disconnects the cylinder line and the switch valve line with respect to each other. The flow control valve includes a communication path chamber. The on-off valve is movably located in the communication path chamber. The on-off valve defines a back pressure chamber in the communication path chamber. A fluid pressure acting on the on-off valve is introduced into the back pressure chamber. The on-off valve selectively opens and shuts off a communication path between the cylinder line and the switch valve line. The valve control device controls operation of the flow control valve and the on-off valve. A restrictor is formed between the flow control valve and a wall defining the valve support chamber. The restrictor connects the cylinder line and the communication path chamber to each other. An opening degree of the restrictor is changed in correspondence with movement of the flow control valve. When the switch valve is located at the neutral position or the supply position, the valve control device applies a fluid pressure in the cylinder line to the back pressure chamber for urging the on-off valve in a direction for shutting off the communication path. When the switch valve is located at the drainage position, the valve control device applies a pilot pressure lower than the fluid pressure in the cylinder line to the back pressure chamber, thereby moving the on-off valve in a direction for opening the communication path.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
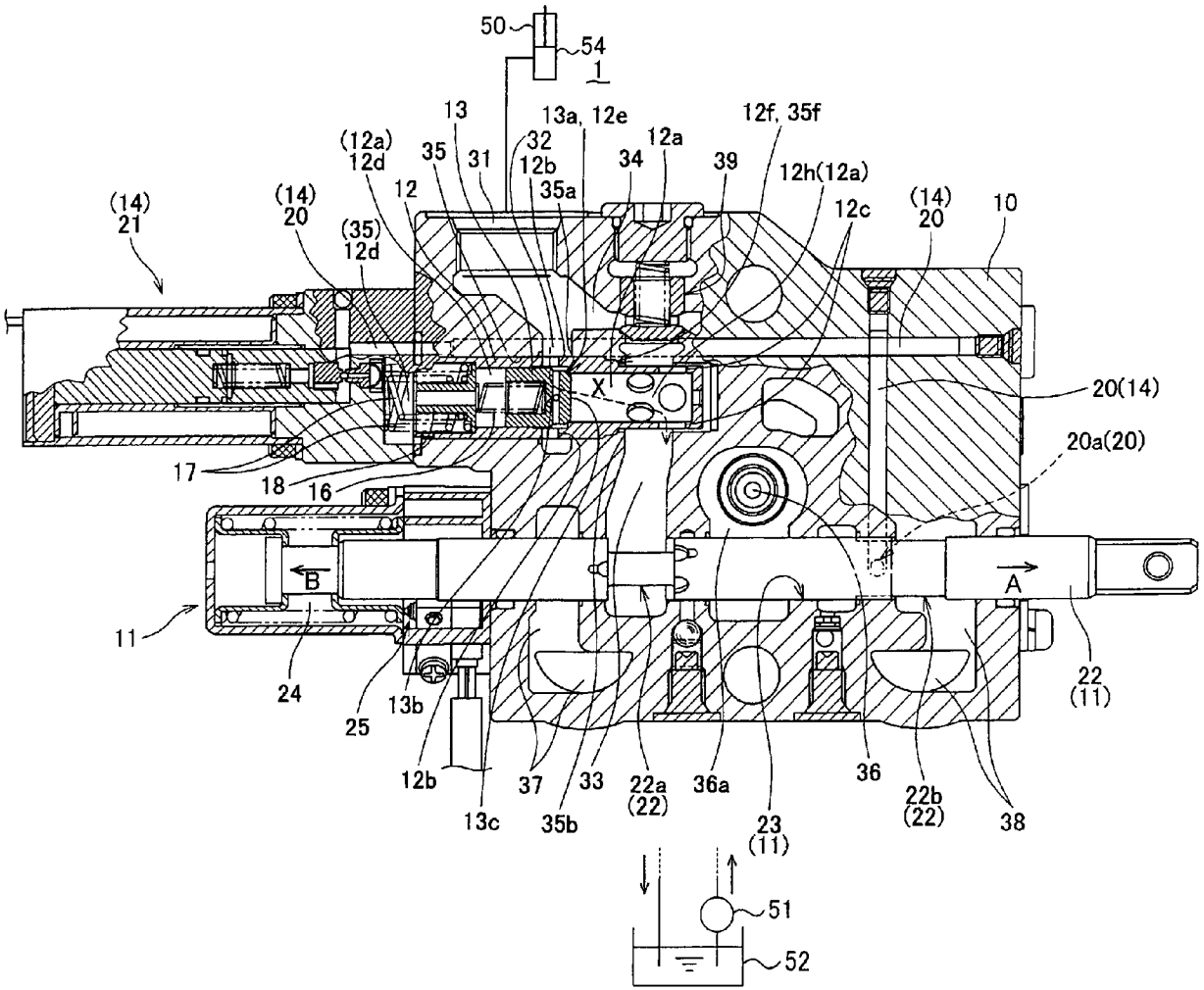
FIG. 1 is a cross-sectional view showing a hydraulic control apparatus according to a first embodiment of the present invention.

FIG. 1 is a cross-sectional view showing a hydraulic control apparatus 1 according to a first embodiment of the invention. The hydraulic control apparatus 1 is employed for actuating a lift cylinder 50 of a forklift, which selectively raises and lowers a fork. The lift cylinder 50 is formed by a single-acting cylinder. The forklift has a lift cylinder control circuit, or a hydraulic circuit in which the lift cylinder 50 is arranged. The hydraulic control apparatus 1 defines a part of the lift cylinder control circuit. The forklift further includes a hydraulic pump 51 and different hydraulic circuits (not shown) including a tilt cylinder control circuit and a power steering system hydraulic circuit. The hydraulic pump 51 supplies hydraulic oil (fluid) to different circuits including the lift cylinder control circuit. The hydraulic oil is then returned from the circuits to a tank 52, which is provided in the forklift, re-pressurized by the hydraulic pump 51, and then recirculated to the circuits.

As shown in FIG. 1, the hydraulic control apparatus 1 includes a valve housing 10, a switch valve 11, n flow control valve 12, an on-off valve 13, and a valve control device 14. Different ports and lines are defined in the valve housing 10, and the switch valve 11, the flow control valve 12, the on-off valve 13, and the valve control device 14 are incorporated in the valve housing 10.

A cylinder port 31 is defined in the valve housing 10 and connected to the lift cylinder 50, thus defining a supply-drainage port for selectively supplying the hydraulic oil to the lift cylinder 50 and draining the hydraulic oil from the lift cylinder 50. The valve housing 10 includes a supply line 36, a first tank line 37, and a second tank line 38. The supply line 36 communicates with the hydraulic pump 51 and is supplied with the hydraulic oil from the hydraulic pump 51. The first and second tank lines 37, 38 communicate with the tank 52. The valve housing 10 further includes a cylinder line 32, a switch valve line 33, and a connection passage 34. The cylinder line 32 is defined continuously from the cylinder port 31 and communicates with the lift cylinder 50 through the cylinder port 31. The switch valve line 33 communicates with the switch valve 11.

The flow control valve 12 is located in a valve support chamber 35 formed between the cylinder line 32 and the switch valve line 33, and can be moved along walls defining the valve support chamber 35. The walls defining the valve support chamber 35 include a cylinder side opening 35*a* and a switch valve side opening 35*b*. The cylinder side opening 35*a* opens to the cylinder line 32 and the switch valve side opening 35*b* opens to the switch valve line 33. A communication path chamber 12*a* is formed in the flow control valve 12. The communication path chamber 12*a* is a cylindrical space for accommodating the on-off valve 13. The flow control valve 12 has a cylinder side through hole 12*b* and a switch valve side through hole 12*c*. The cylinder side through hole 12*b* selectively connects the communication path chamber 12*a* with the cylinder side opening 35*a*. The switch valve side through hole 12*c* selectively connects the communication path chamber 12*a* with the switch valve side opening 35*b*. Accordingly, the cylinder line 32 can be connected to the switch valve line 33 through the communication path chamber 12*a* in the flow control valve 12.

In this manner, the flow control valve 12 and the valve support chamber 35 defines a restrictor between the cylinder side through hole 12*b* and the cylinder side opening 35*a*. The restrictor changes the opening degree between the cylinder line 32 and the communication path chamber 12*a* in accordance with movement of the flow control valve 12. The flow control valve 12 has a spring 17 serving as an urging member and a spring support member 18 at an end in the longitudinal direction. The spring 17 urges the flow control valve 12 through the spring support member 18 in a direction to increase the opening degree of the flow control valve 12 (rightward as viewed in the drawing).

The on-off valve 13 has a columnar shape so that it can be moved along the inner circumference of the communication path chamber 12*a*. The on-off valve 13 divides the communication path chamber 12*a* into a fluid chamber 12*h* and a back pressure chamber 12*d*. The switch valve side through holes 12*c* are located in the fluid chamber 12*h*. Further, the on-off valve 13 selectively shuts off a communication path X (indicated by arrow X in FIG. 1) between the cylinder side through hole 12*b* and the switch valve side through hole 12*c*.

As described above, the back pressure chamber 12*d* is a space formed by a valve support chamber 35 and a zone in which the communication path chamber 12*a*. The back pressure chamber 12*d* serves as a back pressure chamber of the on-off valve, and also as a back pressure chamber of the flow control valve 12.

A pressure introduction line 13*b* is a through hole formed in the on-off valve 13. The pressure introduction line 13*b* selectively connects the back pressure chamber 12*d* with the cylinder side through hole 12*b* and the cylinder line 32, and expose the back pressure chamber 12*d* to the pressure of fluid in the cylinder line 32. The hydraulic pressure in the back pressure chamber 12*d* is controlled by the valve control device 14 as shown below.

Further, the on-off valve 13 has a space defined in it for accommodating a spring 16, which serves as an urging member. In the back pressure chamber 12*d*, the spring 16 is located between the on-off valve 13 and the spring support member 18. The on-off valve 13 is urged in a direction to shut off the communication path X (rightward as viewed in the drawing) by the spring 16. A distal portion 13*a* of the on-off valve 13 contacts a valve seat 12*e*, which is a step formed in the wall defining the communication path chamber 12*a*, so that the communication path X is shut off.

The connection passage 34 is defined in such a manner as to permit communication between the cylinder line 32 and the switch valve line 33. The connection passage 34 is defined separately from a hydraulic oil path (a first line) including the communication path X between the cylinder side through hole 12*b* and the switch valve side through hole 12*c*, and serves as a second line connecting the cylinder line 32 to the switch valve line 33. A check valve 39 is provided between the connection passage 34 and the switch valve line 33.

The switch valve 11 controls supply and drainage of the hydraulic oil with respect to the lift cylinder 50. The switch valve 11 is formed as a spool valve having a spool 22, a spool bore 23, and a spring mechanism 24. The spool 22 is arranged in the spool bore 23 in an axially movable manner. The spring mechanism 24 maintains the spool 22 at a neutral position. The spool 22 is caused to move axially through manipulation of a non-illustrated lift lever, thus switching the switch valve 11 (more specifically, the spool 22) among a supply position, the neutral position, and a drainage position.

In FIG. 1, the switch valve 11 is held at the neutral position at which the switch valve 11 does not permit either supply or drainage of the hydraulic oil with respect to the lift cylinder 50. If the spool 22 moves from the neutral position in a direction indicated by arrow A of FIG. 1, the switch valve 11 is switched to the supply position. In this state, as will be described later, the hydraulic pump 51 supplies the hydraulic oil to the lift cylinder 50, that is, a bottom chamber 54 of the lift cylinder 50 (see FIG. 2). Contrastingly, if the spool 22 moves from the neutral position of FIG. 1 in a direction indicated by arrow B of the drawing, the switch valve 11 is switched to the drainage position. In this state, the hydraulic oil is drained from the lift cylinder 50 to the tank 52 (see FIG. 3). The spool 22 includes a first land portion 22*a* having a relatively small diameter and a second land portion 22*b*, which are formed in two axial portions of the spool 22.

The on-off valve 13, which is constructed as described above, operates based on a first urging force and a second urging force. Specifically, the first urging force is generated at an end face of the on-off valve 13 that faces the back pressure chamber 12*d* due to the force of the spring 16 and the hydraulic pressure acting on the back pressure chamber 12*d*. The second urging force is generated due to hydraulic pressure acting on an end face 13*c* of the on-off valve 13 that faces the fluid chamber 12*h*. If the first urging force is greater than the second urging force, the on-off valve 13 is maintained in contact with the valve seat 12*e*. In contrast, if the second urging force is greater than the first urging force, the on-off valve 13 is shifted to an open state.

Since the fluid chamber 12*h*, in which the end face 13*c* of the on-off valve 13 is located, communicates with the switch valve line 33 through the switch valve side through hole 12*c*, the end face 13*c* of the on-off valve 13 is exposed to a hydraulic pressure that is substantially the same as the hydraulic pressure of the switch valve line 33.

In a state where the on-off valve 13 opens the communication path X, the flow control valve 12, which is constructed as described above, receives, along a direction to increase the opening degree (rightward as viewed in the drawing), the urging force of the spring 17 through the spring support member 18 and the urging force due to the hydraulic pressure acting on the end face of the flow control valve 12 in the back pressure chamber 12*d*. Also, the flow control valve 12 receives, along a direction to decrease the opening degree (leftward as viewed in the drawing), the urging force due to the hydraulic pressure acting on the end face corresponding to the fluid chamber 12*h*. Further, the spring support member 18 receives an urging force that corresponds to the difference in hydraulic pressure between the zones defined by the on-off valve 13, that is, the difference in hydraulic pressure between the back pressure chamber 12*d* and the fluid chamber 12*h*. The flow control valve 12 is maintained at a position where these urging forces are in equilibrium.

In a state where the on-off valve 13 opens the communication path X, when the hydraulic pressure of the fluid chamber 12*h* and the switch valve line 33 is increased, the urging force that acts on the flow control valve 12 and the on-off valve 13, or back pressure chamber 12*d* is increased. The urging force acting on the on-off valve 13 is transmitted to the spring support member 18 through the spring 16. Alternatively, when the on-off valve 13 contacts the spring support member 18, the urging force is transmitted to the spring support member 18 through the spring 16 and the on-off valve 13. Also, the urging force acting on the flow control valve 12 is transmitted to the spring support member 18. Accordingly, the spring 17 is contracted by the spring support member 18, and the flow control valve 12 is moved toward the back pressure chamber 12*d* (leftward as viewed in the drawing) until the elastic force of the spring 17 and the above described urging force are in equilibrium. This reduces the opening degree of the restrictor between the cylinder side through hole 12*b* and the cylinder side opening 35*a*. In this manner, the flow control valve 12 is moved in accordance with the hydraulic pressure of the switch valve line 33.

The valve control device 14 controls operation of the flow control valve 12 and the on-off valve 13, and, as shown in FIG. 1, includes a pilot line 20 and an electromagnetic switch valve 21.

The pilot line 20 is defined in the valve housing 10 as a passage that connects the back pressure chamber 12*d* of the flow control valve 12 and the on-off valve 13 to the tank 52 in correspondence with switching of the electromagnetic switch valve 21. The pilot line 20 defines a pilot pressure generating portion that generates pilot pressure lower than the hydraulic pressure in the cylinder line 32 and applies the hydraulic pressure to the back pressure chamber 12*d*. The pilot line 20 has an opening 20*a* communicating with the spool bore 23 of the switch valve 11. If the spool 22 is moved in the direction indicated by arrow B of FIG. 1, the switch valve 11 is switched to the drainage position of FIG. 3. In this state, a second land portion 22*b* of the spool 22 corresponds to the opening 20*a* and thus the pilot line 20 is connected to a second tank line 38 through the spool bore 23.

In the opening 20*a* of the pilot line 20, only the portion corresponding to the second land portion 22*b* functions as a portion that is permitted to communicate with the second tank line 38. In other words, as the spool 22 moves in the direction indicated by arrow B of FIG. 1, the area of the portion of the opening 20*a* corresponding to the second land portion 22*b* gradually increases. The communication area (the opening degree) of the passage between the pilot line 20 and the second tank line 38 thus gradually increases, correspondingly.

The electromagnetic switch valve 21 is formed by an electromagnetic valve that is switched for selectively connecting and disconnecting the back pressure chamber 12*d* of the flow control valve 12 and the on-off valve 13 to and from the pilot line 20. The electromagnetic switch valve 21 is excited or de-excited by a non-illustrated controller that detects the operational state of a limit switch 25 incorporated in the valve housing 10. When the switch valve 11 is held at the neutral position or the supply position, the electromagnetic switch valve 21 disconnects the back pressure chamber 12*d* from the pilot line 20 (see FIGS. 1 and 2). Contrastingly, if the switch valve 11 is held at the drainage position, the electromagnetic switch valve 21 connects the back pressure chamber 12*d* to the pilot line 20 (see FIGS. 3 and 4). When the back pressure chamber 12*d* is disconnected from the pilot line 20, the hydraulic pressure in the cylinder line 32, which is introduced through the pressure introduction line 13*b* of the on-off valve 13, is applied to the back pressure chamber 12*d* through the pressure introduction line 14*c* of the valve body 14. In contrast, when the back pressure chamber 12*d* is connected to the pilot line 20, the hydraulic pressure in the second tank line 38, which is the aforementioned pilot pressure lower than the hydraulic pressure in the cylinder line 32, is applied to the back pressure chamber 12*d* through the pilot line 20. That is, the electromagnetic switch valve 21 serving as a switch portion operates to apply the hydraulic pressure in the cylinder line 32 to the back pressure chamber 12*d* when the switch valve 11 is held at the neutral or supply positions. The electromagnetic switch valve 21 operates to apply the pilot pressure to the back pressure chamber 12*d* when the switch valve 11 is maintained at the drainage position.

When the hydraulic pressure in the cylinder line 32 is applied to the back pressure chamber 12*d*, the on-off valve 13 is urged toward the valve seat 12*e* in such a manner as to disconnect the cylinder line 32 from the switch valve line 33. In contrast, if the pilot pressure, which is lower than the hydraulic pressure in the cylinder line 32, is applied to the back pressure chamber 12*d*, the on-off valve 13 is spaced from the valve seat 12*e* in such a manner as to connect the cylinder line 32 to the switch valve line 33. In this state, the flow control valve 12 moves in correspondence with the hydraulic pressure in the switch valve line 33, thus adjusting the opening degree of the restrictor between the cylinder side through hole 12*b* and the cylinder side opening 35*a*.

Next, the operation of the hydraulic control apparatus 1 will be explained. If the switch valve 11 is held at the neutral position as shown in FIG. 1, the spool 22 is located in such a manner as to disconnect the supply line 36 and the first tank line 37 from the switch valve line 33. Therefore, the hydraulic oil is neither supplied to nor drained from the switch valve line 33. Further, in this state, the electromagnetic switch valve 21 operates to disconnect the back pressure chamber 12*d* of the on-off valve 13 from the pilot line 20. The hydraulic pressure in the cylinder line 32 is thus introduced into the back pressure chamber 12*d* via the pressure introduction line 13*b*. At this stage, the first urging force generated by the hydraulic pressure in the cylinder line 32 and the spring 16 is greater than the second urging force generated by the hydraulic pressure in the switch valve line 33, the distal portion 13*a* of the on-off valve 13 is caused to contact the valve seat 12*e*. This maintains the cylinder line 32 in a state disconnected from the switch valve line 33. Likewise, the flow control valve 12 is maintained in a state where its stepped portion 12*f* contacts a projection 35*f* on the wall defining the valve support chamber 35. In other words, the on-off valve 13 blocks the flow of the hydraulic oil in a direction in which the hydraulic oil is drained from the lift cylinder 50. This prevents the lift cylinder 50 from retracting (i.e., from lowering due to the own weight) and thus maintains the fork at a predetermined height. Further, the connection passage 34 extending from the cylinder line 32 to the switch valve line 33 is blocked by the check valve 39.

Figure 2:
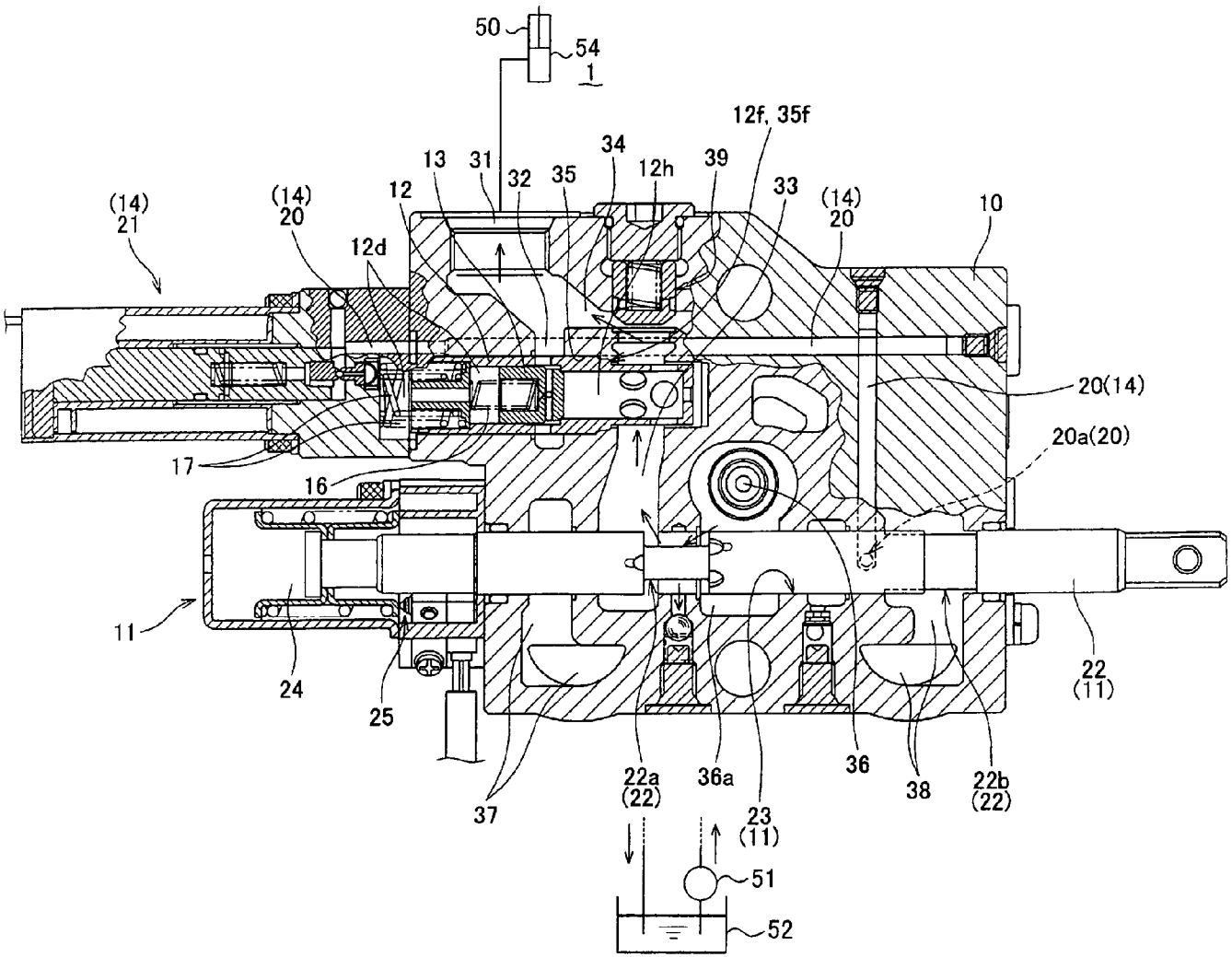
FIG. 2 is a cross-sectional view explaining the operation of the hydraulic control apparatus of FIG. 1.

When the switch valve 11 is switched from the neutral position to the supply position, the hydraulic control apparatus 1 operates in the following manner. FIG. 2 shows the hydraulic control apparatus 1 in which the switch valve 11 is held at the supply position. If the switch valve 11 is switched from the neutral position to the supply position, the spool 22 moves in the direction indicated by arrow A of FIG. 1. Thus, after having been supplied from the pump 51 to the supply line 36, the hydraulic oil is introduced into the switch valve line 33 via a communication passage 36*a* and a passage defined between the first land portion 22*a* of the spool 22 and a corresponding wall of the spool bore 23 as indicated by the corresponding arrows of FIG. 2. In this state, the first tank line 37 is held in a state disconnected from the switch valve line 33. This raises the hydraulic pressure in the switch valve line 33, thus applying a correspondingly increased urging force to the check valve 39. When this urging force exceeds the urging force acting on the check valve 39 generated by the spring and the hydraulic pressure in the cylinder line 32, the check valve 39 becomes open. This connects the switch valve line 33 to the cylinder line 32 through the connection passage 34, thus sending the hydraulic oil to the cylinder line 32. The hydraulic oil is then supplied to the lift cylinder 50 and thus raises the fork. In this state, the electromagnetic switch valve 21 maintains the pilot line 20 in a state disconnected from the back pressure chamber 12*d*. Therefore, the first urging force generated by the hydraulic pressure in the back pressure chamber 12*d* and the spring 16 is greater than the second urging force generated by the hydraulic pressure in the switch valve line 33. The on-off valve 13 is thus maintained closed. Likewise, the flow control valve 12 is maintained in a state where its stepped portion 12*f* contacts a projection 35*f* on the wall defining the valve support chamber 35.

Figure 3:
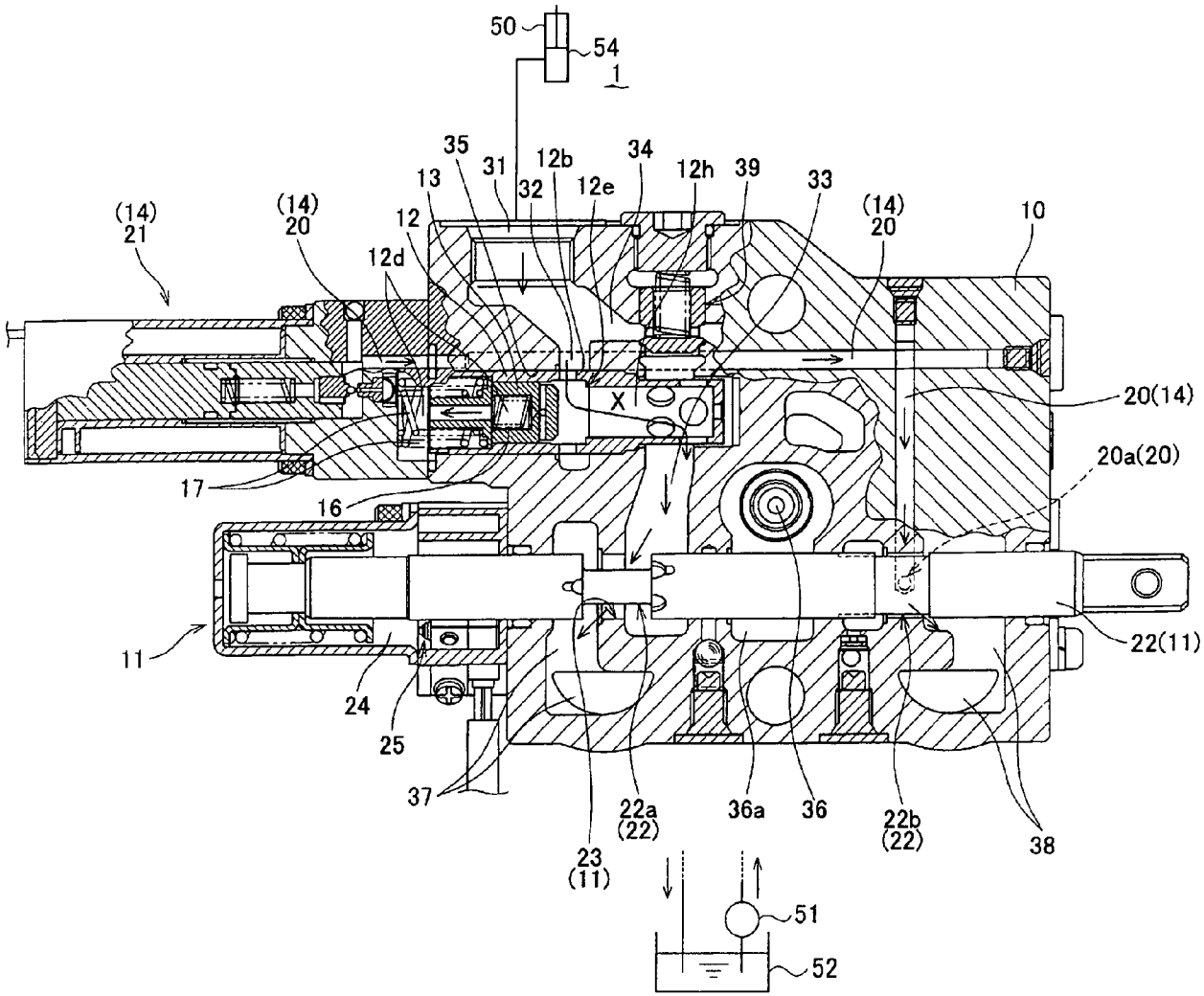
FIG. 3 is a cross-sectional view explaining the operation of the hydraulic control apparatus of FIG. 1.
Figure 4:
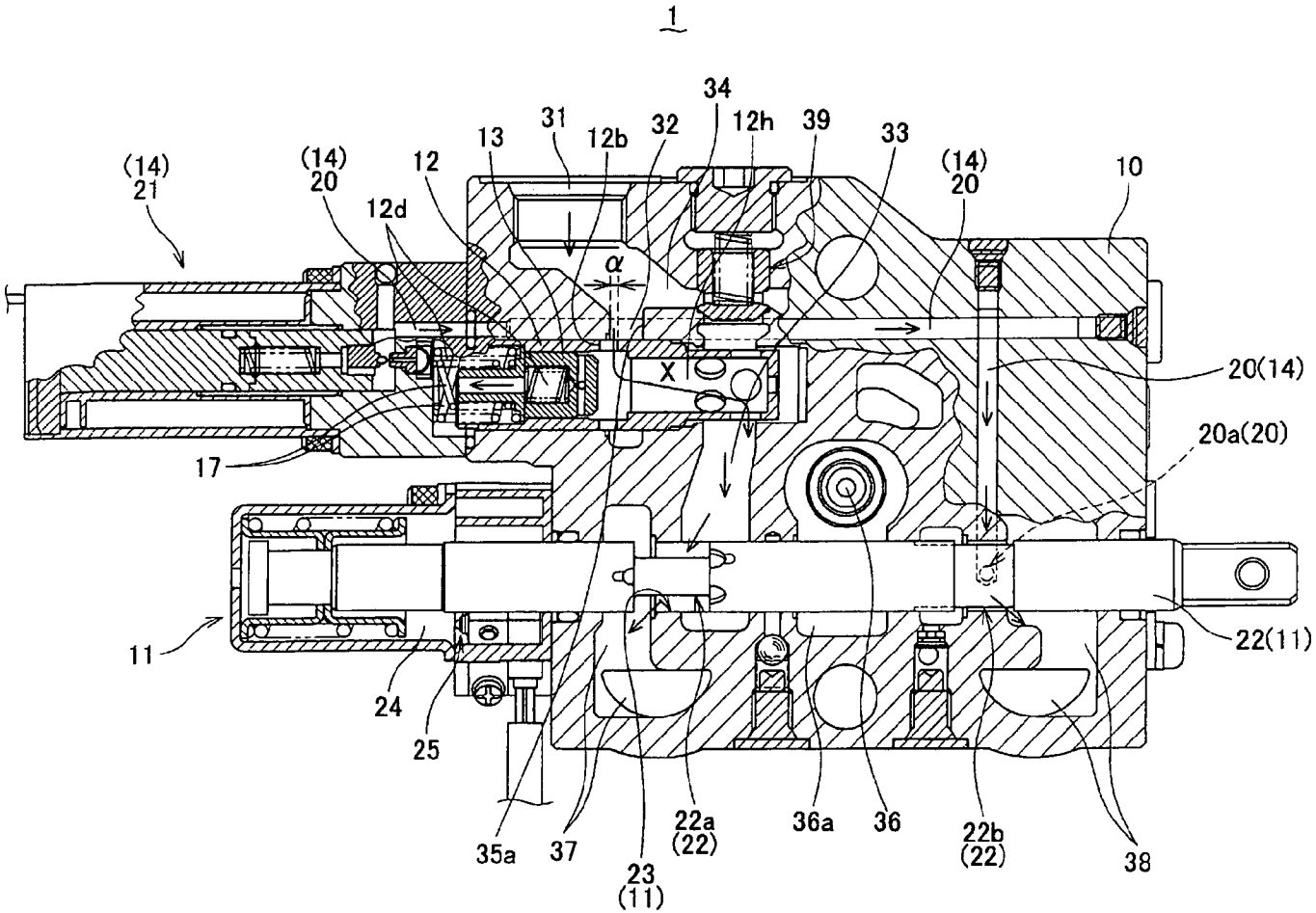
FIG. 4 is a cross-sectional view explaining the operation of the hydraulic control apparatus of FIG. 1.

When the switch valve 11 is switched from the neutral position of FIG. 1 to the drainage position, the hydraulic control apparatus 1 operates as follows. FIG. 3 shows the hydraulic control apparatus 1 in which the switch valve 11 is held at the drainage position, that is, the on-off valve 13 is moved. FIG. 4 shows the hydraulic control apparatus 1 in which the flow control valve 12 is moved together with the movement of the on-off valve 13. If the switch valve 11 is switched from the neutral position to the drainage position, the spool 22 moves in the direction indicated by arrow B of FIG. 1. The switch valve line 33 is thus connected to the first tank line 37 through a passage defined between the first land portion 22*a* of the spool 22 and the corresponding wall of the spool bore 23.

Further, if the switch valve 11 is switched to the drainage position, the limit switch 25 generates a detection signal. In response to the detection signal, the controller (not shown) switches the electromagnetic switch valve 21 in such a manner as to connect the pilot line 20 to the back pressure chamber 12*d*. The hydraulic oil is thus sent from the back pressure chamber 12*d* to the pilot line 20.

Meanwhile, in correspondence with the movement of the spool 22, the second land portion 22*b* reaches a position corresponding to the opening 20*a* of the pilot line 20. As the spool 22 further moves, the portion of the opening 20*a* blocked by the spool 22 becomes gradually smaller and, in contrast, the portion of the opening 20*a* corresponding to the second land portion 22*b* becomes gradually larger. Accordingly, the communication area (the opening degree) of the passage between the pilot line 20 and the second tank line 38 gradually increases, thus increasing the flow rate of the hydraulic oil from the pilot line 20 to the second tank line 38, correspondingly. Once the opening 20*a* entirely corresponds to the second land portion 22*b*, the communication state of the pilot line 20 with respect to the second tank line 38 is maintained without changing.

When the switch valve 11 is switched to the drainage position, the hydraulic oil flows from the back pressure chamber 12*d* to the second tank line 38 through the pilot line 20 as indicated by the corresponding arrows of FIG. 3. This lowers the pressure in the back pressure chamber 12*d*. In other words, the pilot pressure lower than the hydraulic pressure in the cylinder line 32 acts in the back pressure chamber 12*d*. Therefore, the second urging force generated by the hydraulic pressure in the fluid chamber 12*h* becomes greater than the first urging force generated by the hydraulic pressure in the back pressure chamber 12*d* and the spring 16. This causes the on-off valve 13 to separate from the valve seat 12*e*, thus opening the communication path X between the cylinder side through hole 12*b* and the switch valve side through hole 12*c*. The hydraulic oil thus flows from the lift cylinder 50 to the switch valve line 33 via the cylinder line 32 and the communication path X. The hydraulic fluid is then sent from the first tank line 37 to the tank 52, thus lowering the fork.

Further, if the hydraulic pressure in the switch valve line 33 changes when the switch valve 11 is held at the drainage position and the hydraulic fluid flows out of the lift cylinder 50 as shown in FIG. 4, or when the fork is being lowered, the equilibrium between the first urging force, which is generated by the hydraulic pressure in the back pressure chamber 12*d* and the spring 17, and the second urging force, which is generated by the hydraulic pressure in the fluid chamber 12*h*, is quickly cancelled, which displaces the flow control valve 12. This changes the opening degree $\alpha$ of the restrictor between the cylinder side through hole 12*b* and the cylinder side opening 35*a*.

As a result, the flow rate of the hydraulic oil from the cylinder line 32 to the fluid chamber 12*h* is changed, so that the hydraulic pressure of oil flowing from the switch valve side through hole 12*c* to the switch valve line 33 is adjusted. In this manner, the lowering speed of the fork is adjusted (pressure compensation function).

As has been described, when the switch valve 11 is held at the neutral position in the hydraulic control apparatus 1 of the first embodiment, the hydraulic pressure in the cylinder line 32 is applied to the back pressure chamber 12*d* of the on-off valve 13 for urging the on-off valve 13 in such a manner as to disconnect the cylinder line 32 from the switch valve line 33. Therefore, with the switch valve 11 held at the neutral position, the on-off valve 13 is maintained in a state in which the cylinder line 32 is disconnected from the switch valve line 33. This restricts the drainage of the hydraulic oil from the lift cylinder 50 and thus retracting motion of the lift cylinder 50. That is, as long as the switch valve 11 is maintained at the neutral position, the flow control valve 12, in which the on-off valve 13 is provided, functions as an operated check valve.

If the switch valve 11 is switched from the neutral position to the drainage position, the pilot pressure lower than the hydraulic pressure in the cylinder line 32 is applied to the back pressure chamber 12*d* of the on-off valve 13. This reduces the urging force applied from the back pressure chamber 12*d* to the on-off valve 13, thus switching the on-off valve 13 from a closed state to an open state, or to a state allowing the cylinder line 32 and the communication path X to communicate with each other. The hydraulic oil is thus drained from the lift cylinder 50 to the tank 52. With the switch valve 11 held at the drainage position, the flow control valve 12 is permitted to move in the valve support chamber 35 in correspondence with change of the hydraulic pressure in the switch valve line 33. In correspondence with the movement of the flow control valve 12, the opening degree of the restrictor provided between the cylinder line 32 and the fluid chamber 12*h* changes. Accordingly, the flow control valve 12, in which the on-off valve 13 is provided, functions also as a flow regulator for adjusting the flow rate of the fluid drained from the lift cylinder 50.

That is, since the on-off valve 13 serving as a flow regulator is located inside the flow control valve 12 serving as an operated check valve, the flow control valve 12 serves both as an operated check valve and a flow regulator. This makes it unnecessary to provide an operated check valve and a flow regulator separately from each other, simplifying the configuration of the hydraulic control apparatus 1.

Further, the on-off valve 13 can shut off communication path X independently of movement of the flow control valve 12. That is, the shutting off operation is hardly influenced by changes in the opening degree of the flow control valve 12. Therefore, in the case where the communication path X stops drainage while being narrowed by the flow control valve 12, the lowering motion of the fork by the lift cylinder 50 can be stopped by shutting off the communication path X by the on-off valve 13 without maximizing the opening degree of the flow control valve 12. Thus, when stopping the drainage, the flow rate of fluid is prevented from being instantly increased, and the lift cylinder 50 is stopped in a stable manner.

If the hydraulic pressure in the fluid chamber 12*h*, which is part of the communication path X, rises when the switch valve 11 is held at the drainage position and the hydraulic fluid is drained from the lift cylinder 50, the opening degree of the restrictor of the flow control valve 12 decreases and the hydraulic pressure in the switch valve line 33 drops. The flow rate of the hydraulic oil drained from the lift cylinder 50 is thus adjusted in a predetermined range. That is, the lowering speed of the fork is adjusted correspondingly (the pressure compensation function).

Since the valve seat 12*e* with which the on-off valve 13 is held in contact is integrally formed with the communication path chamber 12*a*, the configuration of the on-off valve 13, which is used for shutting off and opening the communication path X becomes further simple.

The pressure introduction line 13*b* is defined in the on-off valve 13. Therefore, when the switch valve 11 is held at the neutral or supply positions, the hydraulic pressure is supplied from the cylinder line 32 to the back pressure chamber 12*d* by means of a relatively simple structure.

The valve control device 14 is formed by the pilot line (the pilot pressure generating portion) 20 and the electromagnetic switch valve (the switch portion) 21, which cooperates with each other. By operating the electromagnetic switch valve 21 with the pilot line 20 maintained in a state generating the pilot pressure, the pilot pressure is quickly supplied to the back pressure chamber 12*d* in response to such operation. This improves the response of the on-off valve 13.

Further, the pilot pressure generating portion for generating the pilot pressure lower than the hydraulic pressure in the cylinder line 32 is relatively easily provided simply by defining the pilot line 20, which connects the back pressure chamber 12*d* to the tank 52. This permits the flow control valve 12 to operate in such a manner that the difference between the hydraulic pressure in the switch valve line 33 upstream from the switch valve 11 and the hydraulic pressure in the second tank line 38 (the tank 52) downstream from the switch valve 11 is maintained in a predetermined range. Accordingly, regardless of the load pressure acting on the fork, the fork lowering speed is adjusted in accordance with the operational amount of the switch valve 11 (the pressure compensation function).

When the switch valve 11 is switched to the drainage position, the portion of the opening 20*a* corresponding to the second land portion 22*b* becomes gradually larger in correspondence with the movement of the spool 22 in the spool bore 23. This gradually changes the communication state of the back pressure chamber 12*d* with respect to the tank 52. Therefore, at an initial stage of switching of the switch valve 11 to the drainage position, the opening degree of the on-off valve 13 gradually increases, thus permitting the fork to be finely controlled when being lowered. These advantages are brought about simply by forming the second land portion 22*b* in the spool 22 and connecting the pilot line 20 to the spool bore 23 through the opening 20*a*.

Further, since the hydraulic oil leaking from the electromagnetic switch valve 21, which is arranged between the back pressure chamber 12*d* and the pilot line 20, is extremely small, leakage of the hydraulic oil from the electromagnetic switch valve 21 to the tank 52 is suppressed. Therefore, when the switch valve 11 is held at the neutral position, the retraction of the lift cylinder 50 is suppressed, thus preventing the fork from lowering due to the weight of the fork.

When the switch valve 11 is switched to the supply position, the hydraulic oil is supplied from the switch valve line 33 to the cylinder line 32 through the connection passage 34, which is different from the communication path X. This simplifies the configuration of the connection passage 34, thus decreasing the pressure loss caused through the supply of the hydraulic oil to the lift cylinder 50.

Figure 5:
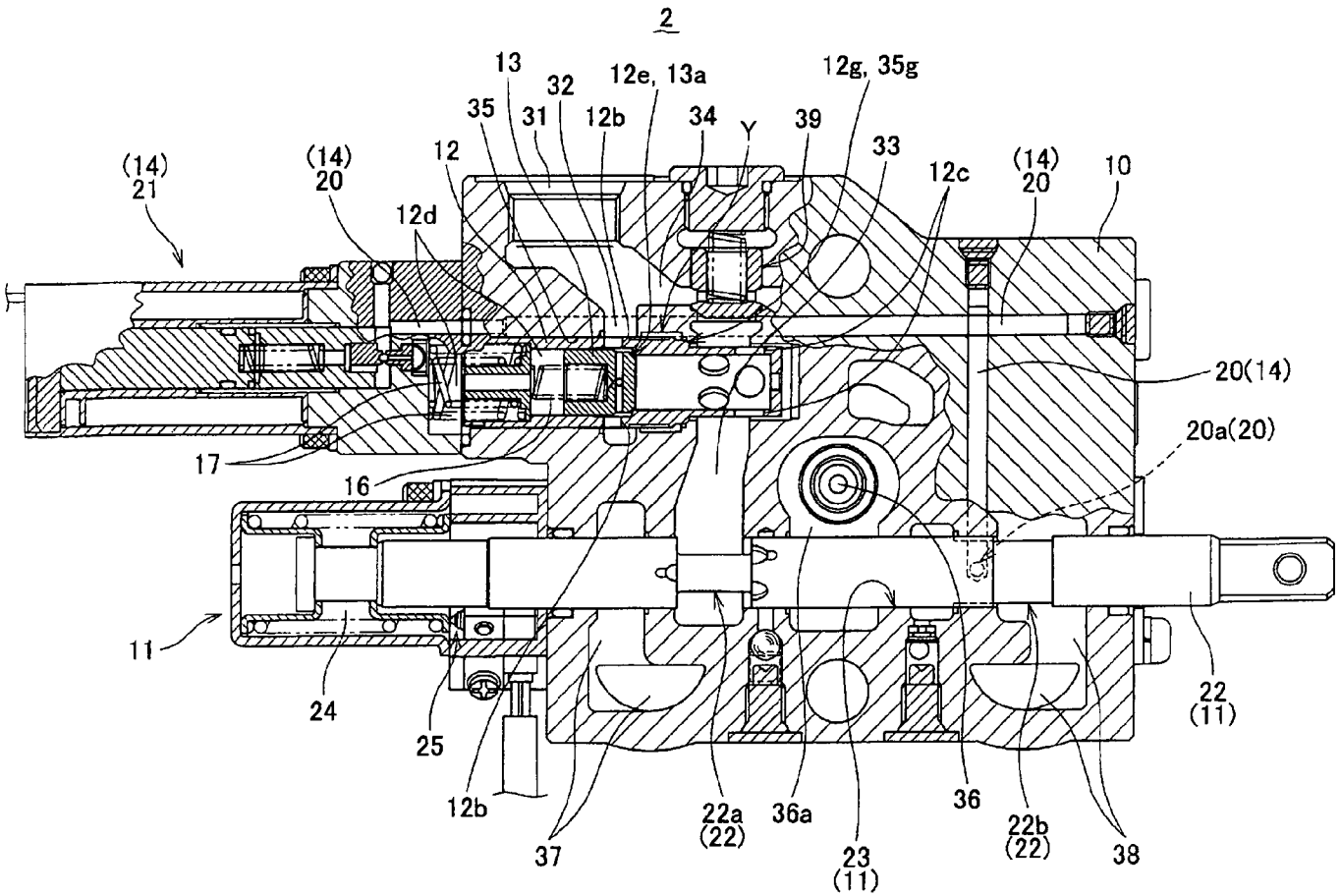
FIG. 5 is a cross-sectional view showing a hydraulic control apparatus according to a second embodiment of the present invention.

FIG. 5 is a cross-sectional view showing a hydraulic control apparatus 2 according to a second embodiment of the present invention.

The hydraulic control apparatus 2 shown in FIG. 5 is different from the hydraulic control apparatus 1 of the first embodiment in that an auxiliary communication path Y is formed between the wall defining the valve support chamber 35 and the outer circumferential surface of the flow control valve 12. The auxiliary communication path Y includes a groove formed in the wall defining the valve support chamber 35 and a groove formed in the outer circumferential surface of the flow control valve 12. In the second embodiment, like or the same reference numerals are given to those components that are like or the same as the corresponding components of the first embodiment.

The operation of the hydraulic control apparatus 2 will now be described. If the switch valve 11 is held at the neutral position as shown in FIG. 5, the on-off valve 13 is held at a closed state with its distal portion 13*a* held in contact with the valve seat 12*e* as in the case of the first embodiment. A step-like auxiliary valve portion 12*g* is formed on the outer circumferential surface of the flow control valve 12 and an auxiliary valve seat 35*g* is formed on the wall defining the valve support chamber 35. The flow control valve 12 is urged by the spring 17 so that the auxiliary valve portion 12*g* contacts and seated on the auxiliary valve seat 35*g*. In this state, the auxiliary communication path Y is blocked. That is, the flow of hydraulic oil exiting the lift cylinder 50 is blocked by the contacting portions of on-off valve 13 and the auxiliary valve portion 12*g* with the auxiliary valve seat 35*g*. This prevents the lift cylinder 50 from retracting and thus maintains the fork at a predetermined height.

Switching of the switch valve 11 from the neutral position to the supply position is the same as that of the first embodiment.

Figure 6:
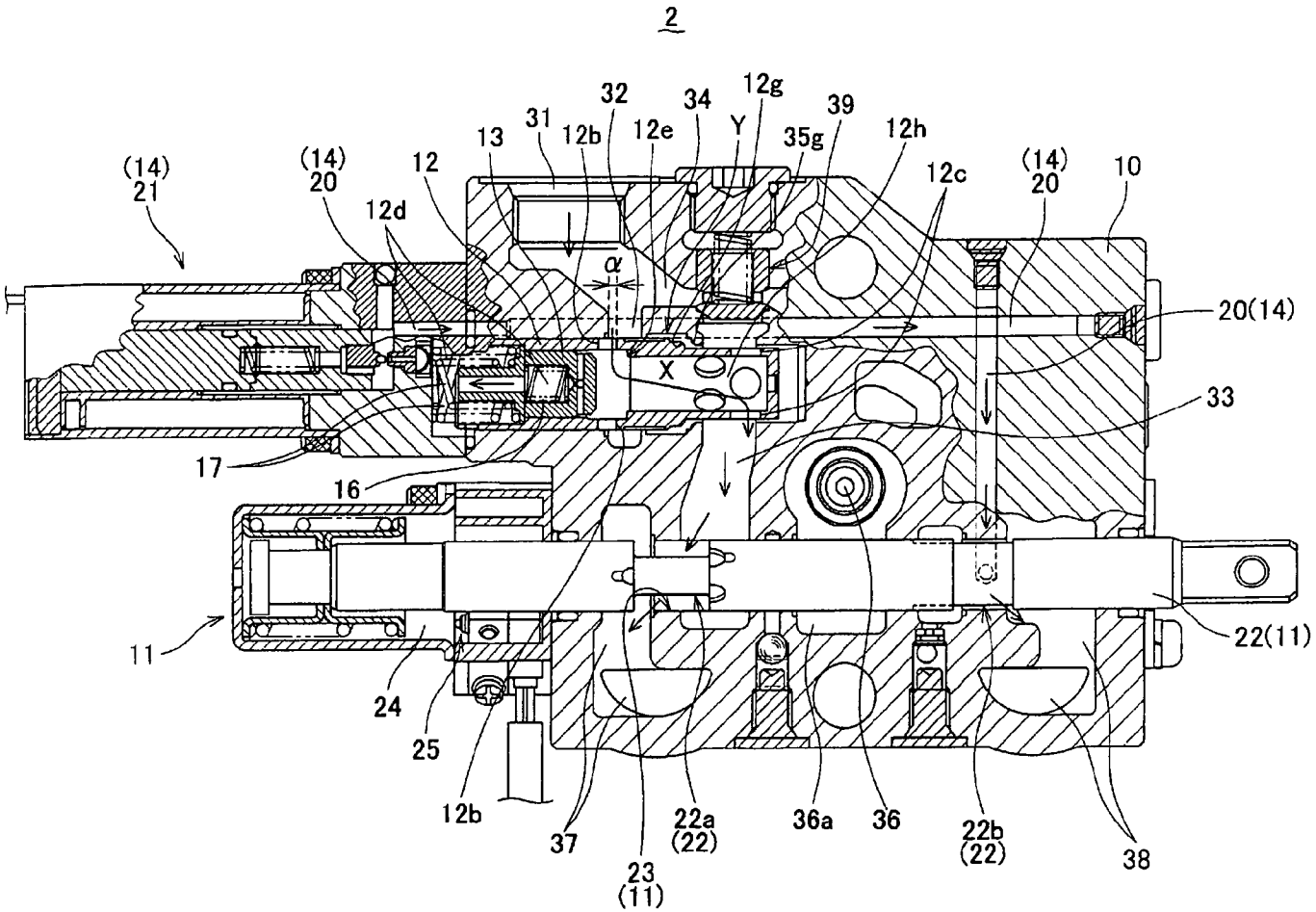
FIG. 6 is a cross-sectional view explaining the operation of the hydraulic control apparatus of FIG. 5.

When the switch valve 11 is switched from the neutral position of FIG. 5 to the drainage position, the hydraulic control apparatus 2 operates as follows. FIG. 6 is a cross-sectional view showing the hydraulic control apparatus 2, when the switch valve 11 is at the drainage position. If the switch valve 11 is switched from the neutral position to the drainage position, the on-off valve 13 separates from the valve seat 12*e*, thus opening the communication path X connecting the cylinder side through hole 12*b* with the switch valve side through hole 12*c*. If the hydraulic pressure in the fluid chamber 12*h*, which is part of the communication path X, rises when the switch valve 11 is held at the drainage position and the hydraulic fluid is being drained, the urging force acting on the flow control valve 12 from the fluid chamber 12*h* is increased, so that the flow control valve 12 is moved in a direction contracting the spring 17 (leftward as viewed in the drawing). This reduces the opening degree $\alpha$ of the restrictor between the cylinder line 32 and the fluid chamber 12*h*. At this time, the auxiliary valve portion 12*g* is moved together with the flow control valve 12, so as to be shifted from the seated state on the auxiliary valve seat 35*g* to a separated state. This opens the auxiliary communication path Y from the shut off state.

When the movement of the flow control valve 12 is small and the opening degree $\alpha$ of the restrictor is great, the flow rate of fluid flowing through the auxiliary communication path Y is small in comparison with the flow rate of fluid flowing to the fluid chamber 12*h* through the cylinder side through hole 12*b*. The flow through the auxiliary communication path Y is substantially maintained to a constant level. Thus, when the movement of the flow control valve 12 is great and the opening degree $\alpha$ of the restrictor is small, the flow rate of fluid flowing through the auxiliary communication path Y is great in comparison with the flow rate of fluid flowing to the fluid chamber 12*h* through the cylinder side through hole 12*b*. Therefore, even if an excessive displacement of the flow control valve 12 causes the path through the cylinder side through hole 12*b* to be completely blocked, hydraulic oil is drained from the cylinder line 32 to the switch valve line 33 through the auxiliary communication path Y at a certain flow rate.

Thus, while the fork is being lowered, drainage from the cylinder line 32 to the switch valve line 33 is not stopped. This permits the fork to be smoothly lowered. Further, since the auxiliary valve seat 35*g* is integrally formed with the valve support chamber 35, the structure for shutting off the auxiliary communication path Y with the auxiliary valve portion 12*g* is simplified. The structure is thus easily formed.

Figure 7:
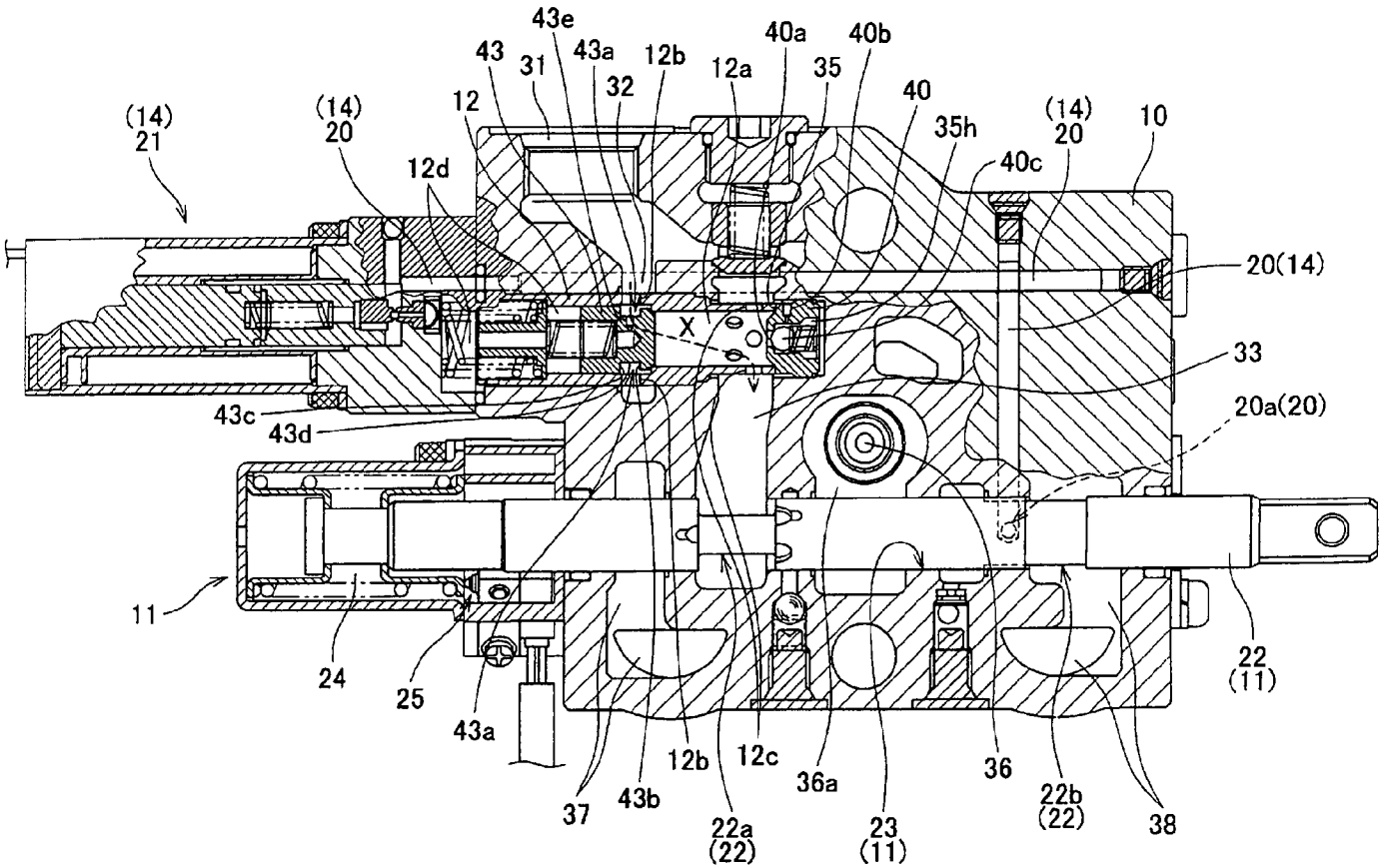
FIG. 7 is a cross-sectional view showing a hydraulic control apparatus according to a third embodiment of the present invention.

FIG. 7 is a cross-sectional view showing a hydraulic control apparatus 3 according to a third embodiment of the present invention. The hydraulic control apparatus 3 shown in FIG. 7 is different from the first embodiment in that a damper 40 is provided at an end of the flow control valve 12. Also, an on-off valve 43, which has a shape different from that of the on-off valve 13 of the first embodiment, is provided. Like or the same reference numerals are given to those components that are like or the same as the corresponding components of the first embodiment.

In the hydraulic control apparatus 3, the damper 40 is located at an end of the flow control valve 12 that is opposite to the back pressure chamber 12*d*, and defines the valve support chamber 35. The damper 40 has an oil chamber 35*h*.

The damper 40 is attached to the flow control valve 12 so as to be moved as the flow control valve 12 is moved, and has a first passage 40*a* and a second passage 40*b*, which connect the interior of the oil chamber 35*h* with the outside. A check valve 40*c* is located in the first passage 40*a*. The check valve 40*c* only permits flow of fluid from the communication path chamber 12*a* toward the oil chamber 35*h*. The second passage 40*b* is an orifice that connects the oil chamber 35*h* with the switch valve line 33 and has a great flow resistance.

When fluid flows into the oil chamber 35*h*, fluid flows in through the first passage 40*a* at a low flow resistance. When fluid is drained from the oil chamber 35*h*, the fluid flows out through the second passage 40*b* having a great flow resistance since the check valve 40*c* in the first passage 40*a* blocks the flow of the fluid.

When the switch valve 11 is switched to the drainage position, the flow control valve 12 is moved, based on the operation of the valve control device 14, in a direction to increase the volume of the oil chamber 35*h*, that is, in a direction to reduce the opening degree (leftward as viewed in the drawing). In this case, hydraulic oil flows into the oil chamber 35*h* through the first passage 40*a*, which has a small flow resistance. Thus, when the flow control valve 12 is moved in a direction to reduce the opening degree, the damper 40 receives a small movement resistance.

In contrast, when the flow control valve 12 is moved in a direction to reduce the volume of the oil chamber 35*h*, that is, in a direction to increase the opening degree (rightward as viewed in the drawing), the hydraulic oil in the oil chamber 35*h* flows out, at a reduced flow rate, to the switch valve line 33 through the second passage 40*b*. Thus, when the flow control valve 12 is moved in a direction to increase the opening degree, the damper 40 receives a great movement resistance. The movement rate of the flow control valve 12 is reduced, accordingly.

In this manner, the damper 40 damps hydraulic pulsation that may be generated through movement of the flow control valve 12. Accordingly, when the fork carries an object and is lowered in this state, vibration is prevented from being caused in the object due to the hydraulic pulsation.

The flow resistance of fluid flowing out of the oil chamber 35*h* is made greater than the flow resistance of fluid flowing into the oil chamber 35*h* by a simple and easy-to-form configuration of the first passage 40*a*, in which the check valve 40*c* is located, and the second passage 40*b* including an orifice.

A groove 43*a* is formed in the outer circumferential surface of the on-off valve 43. The groove 43*a* communicates with the cylinder side through hole 12*b* when the communication path X is shut off. The groove 43*a* is defined by a first surface 43*b*, which is perpendicular to the moving direction of the on-off valve 43, a second surface 43*c*, which faces and is parallel to the first surface 43*b*, and a bottom 43*d* connecting the first surface 43*b* and the second surface 43*c* to each other. The first surface 43*b* receives a force that urges the on-off valve 43 in a direction to shut off the communication path X (rightward as viewed in the drawing). The second surface 43*c* receives a force that urges the on-off valve 43 in a direction to open the communication path X (leftward as viewed in the drawing). The area of the first surface 43*b* is smaller than the area of the second surface 43*c*. A pressure introduction line 43*e* is formed through the groove bottom 43*d*. The pressure introduction line 43*e* connects the cylinder line 32 to the back pressure chamber 12*d*, thereby exposing the back pressure chamber 12*d* to the pressure of the fluid in the cylinder line 32.

In the present embodiment, the first surface 43*b* and the second surface 43*c* are perpendicular to the movement direction of the on-off valve 43. However, the surfaces 43*b*, 43*c* do not need to be perpendicular to the movement direction as long as the projected area of the first surface 43*b* on a plane the normal line of which agrees with the movement direction of the on-off valve 43 is smaller than the projected area of the second surface 43*c* on the same plane.

Accordingly, in the groove 43*a*, the difference of pressure receiving area in the movement direction of the on-off valve 43 increases the urging force in a direction to open the communication path X. This urging force acts as resistance against movement when the on-off valve 43 is moved in a direction to shut off the communication path X.

Also, compared to the case where the on-off valve 43 is moved in an opening direction, the second surface 43*c*, which projects further outward in the radial direction of the on-off valve 43 than the first surface 43*b* receives a greater flow resistance in the case where the on-off valve 43 is moved in the shutting off direction. Accordingly, the on-off valve 43 can be moved in the shutting off direction at a relatively low speed, which reduces the shock caused by shutting off the communication path X.

The present invention is not limited to the illustrated embodiments, but may be modified in the following forms.

The illustrated embodiments each have been described for a hydraulic control apparatus for actuating the lift cylinder 50 of the forklift. However, the present invention may be applied to hydraulic control apparatuses for actuating different types of single-acting cylinders other than the lift cylinder 50.

The shapes of the valve support chamber 35, the flow control valve 12, and the on-off valve 13 do not necessarily have to be those of the illustrated embodiments but may be modified as needed.

The pilot pressure generating portion does not necessarily have to be formed by the pilot line 20 that introduces the pressure in the tank 52 into the back pressure chamber 12*d*. The pilot pressure generating portion may be configured in any other suitable manner as long as the pilot pressure lower than the hydraulic pressure in the cylinder line 32 is generated and applied to the back pressure chamber 12*d*. Also, the switch portion does not necessarily have to be formed by the electromagnetic switch valve 21. For example, the pilot pressure generating portion may be formed by a switch valve of a hydraulic pilot type instead of an electromagnetic switch valve. In this case, the valve control apparatus can be switched without using electrical wiring.

The switch valve 11 is not limited to a manually operated type but may be formed by an electromagnetic proportional control valve. In this case, the hydraulic control apparatus 1 is formed as an electromagnetic hydraulic control system.

The invention claimed is:

1. A hydraulic control apparatus for a cylinder, comprising:

a switch valve for controlling supply and drainage of a fluid with respect to the cylinder, the switch valve being switched among a supply position for supplying the fluid to the cylinder, a drainage position for draining the fluid from the cylinder, and a neutral position for preventing the supply and the drainage of the fluid with respect to the cylinder;

a cylinder line connected to the cylinder;

a switch valve line connected to the switch valve;

a valve support chamber arranged between the cylinder line and the switch valve line;

a flow control valve movably located in the valve support chamber, the flow control valve selectively connecting and disconnecting the cylinder line and the switch valve line with respect to each other, the flow control valve including a communication path chamber;

an on-off valve movably located in the communication path chamber, the on-off valve defines a back pressure chamber in the communication path chamber, a fluid pressure acting on the on-off valve is introduced into the back pressure chamber, the on-off valve selectively opening and shutting off a communication path between the cylinder line and the switch valve line; and a valve control device for controlling operation of the flow control valve and the on-off valve, wherein a restrictor is formed between the flow control valve and a wall defining the valve support chamber, the restrictor connecting the cylinder line and the communication path chamber to each other, an opening degree of the restrictor being changed in correspondence with movement of the flow control valve, wherein, when the switch valve is located at the neutral position or the supply position, the valve control device applies a fluid pressure in the cylinder line to the back pressure chamber for urging the on-off valve in a direction for shutting off the communication path, and when the switch valve is located at the drainage position, the valve control device applies a pilot pressure lower than the fluid pressure in the cylinder line to the back pressure chamber, thereby moving the on-off valve in a direction for opening the communication path.

2. A hydraulic control apparatus for a cylinder, comprising:

a switch valve for controlling supply and drainage of a fluid with respect to the cylinder, the switch valve being switched among a supply position for supplying the fluid to the cylinder, a drainage position for draining the fluid from the cylinder, and a neutral position for preventing the supply and the drainage of the fluid with respect to the cylinder;

a cylinder line connected to the cylinder;

a switch valve line connected to the switch valve;

a valve support chamber arranged between the cylinder line and the switch valve line, the valve support chamber having a cylinder side opening communicating with the cylinder line and a switch valve side opening communicating with the switch valve line;

a flow control valve movably located in the valve support chamber, the flow control valve selectively connecting and disconnecting the cylinder line and the switch valve line with respect to each other, the flow control valve including a communication path chamber, the flow control valve having a cylinder side through hole that connects the communication path chamber with the cylinder side opening and a switch valve side through hole that connects the communication path chamber with the switch valve side opening;

an on-off valve movably located in the communication path chamber, the on-off valve defines a back pressure chamber in the communication path chamber, a fluid pressure acting on the on-off valve is introduced into the back pressure chamber, the on-off valve selectively opening and shutting off a communication path between the cylinder line and the switch valve line; and a valve control device for controlling operation of the flow control valve and the on-off valve, wherein a restrictor is formed between the flow control valve and a wall defining the valve support chamber, the restrictor connecting the cylinder line and the communication path chamber to each other, an opening degree of the restrictor being changed in correspondence with movement of the flow control valve, wherein, when the switch valve is located at the neutral position or the supply position, the valve control device applies a fluid pressure in the cylinder line to the back pressure chamber for urging the on-off valve in a direction for shutting off the communication path, and when the switch valve is located at the drainage position, the valve control device applies a pilot pressure lower than the fluid pressure in the cylinder line to the back pressure chamber, thereby moving the on-off valve in a direction for opening the communication path.

3. The apparatus according to claim 2, wherein the apparatus is connected to a pump and a tank, wherein, when the switch valve is switched to the supply position, the fluid sent from the pump is permitted to flow into the switch valve line, when the switch valve is switched to the drainage position, the fluid is permitted to flow from the switch valve line to the tank, and when the switch valve is switched to the neutral position, the switch valve line is disconnected from the pump and the tank.

4. The apparatus according to claim 2, wherein the flow control valve moves in correspondence with a fluid pressure in the switch valve line in such a manner that the opening degree of the restrictor becomes smaller as the fluid pressure in the switch valve line becomes greater.

5. The apparatus according to claim 2, wherein an urging member is provided in the back pressure chamber, the urging member urging the on-off valve in the direction for shutting off the communication path.

6. The apparatus according to claim 2, wherein an urging member is provided in the back pressure chamber, the urging member urging the flow control valve in the direction for increasing the opening degree.

7. The apparatus according to claim 2, wherein the wall defining the communication path chamber forms a valve seat with which the on-off valve is brought into contact, the communication path being shut off when the on-off valve contacts the valve seat.

8. The apparatus according to claim 2, wherein a pressure introduction line is defined in the on-off valve for connecting the cylinder line to the back pressure chamber.

9. The apparatus according to claim 2, wherein the valve control device includes:

a pilot pressure generating portion for generating the pilot pressure; and a switch portion switched in such a manner that the fluid pressure in the cylinder line is permitted to be applied to the back pressure chamber when the switch valve is located at the neutral position or the supply position, and that the pilot pressure is permitted to be applied to the back pressure chamber when the switch valve is located at the drainage position.

10. The apparatus according to claim 9, wherein, when the switch valve is switched to the drainage position, the fluid is permitted to flow from the switch valve line into a tank connected to the apparatus, and wherein the pilot pressure generating portion includes a pilot line that is connectable to the tank.

11. The apparatus according to claim 10, wherein the switch valve is formed by a spool valve having a spool bore and a spool movably received in the spool bore, and wherein the pilot line includes an opening communicating with the spool bore, the pilot line being permitted to communicate with the tank with a gradually increasing communication area in correspondence with movement of the spool when the switch valve is being switched to the drainage position.

12. The apparatus according to claim 11, wherein the spool has a land portion for permitting the opening of the pilot line to communicate with the tank, a size of a portion of the opening corresponding to the land portion being gradually changed in correspondence with the movement of the spool.

13. The apparatus according to claim 9, wherein the switch portion is formed by an electromagnetic switch valve that is switched for selectively connecting and disconnecting the back pressure chamber and the pilot line with respect to each other.

14. The apparatus according to claim 2, further comprising an auxiliary communication path defined between the wall defining the valve support chamber and an outer circumferential surface of the flow control valve, the auxiliary communication path being capable of connecting the cylinder line to the switch valve line, wherein the auxiliary communication path is shut off when a part of the wall defining the valve support chamber and a part of the outer circumferential surface of the flow control valve contact each other, and wherein, when shut off, the auxiliary communication path is shifted to an open state as the flow control valve is moved in the direction for reducing the opening degree of the restrictor.

15. The apparatus according to claim 14, wherein the low control valve includes an auxiliary valve portion that is formed as a step on the outer circumferential surface of the flow control valve, wherein a part of the wall defining the valve support chamber forms an auxiliary valve seat, and wherein the auxiliary valve portion separates from the auxiliary valve seat as the flow control valve is moved in the direction for reducing the opening degree of the restrictor.

16. The apparatus according to claim 14, further comprising a connection passage that is different from both the communication path and the auxiliary communication path, the connection passage extending between the cylinder line and the switch valve line, wherein, when the switch valve is switched to the supply position, the fluid is permitted to flow from the switch valve line to the cylinder line through the connection passage.

17. The apparatus according to claim 2, further comprising a connection passage that is different from the communication path, the connection passage extending between the cylinder line and the switch valve line, wherein, when the switch valve is switched to the supply position, the fluid is permitted to flow from the switch valve line to the cylinder line through the connection passage.

18. The apparatus according to claim 2, wherein the flow control valve further comprising a damper located at an end of flow control valve that is opposite to an end corresponding to the back pressure chamber, the damper defining the valve support chamber and forming an oil chamber, wherein damper has a passage connecting the interior of the oil chamber to the outside, and wherein the flow resistance when the fluid is drained from the oil chamber is greater than the flow resistance when the fluid flows into the oil chamber.

19. The apparatus according to claim 18, wherein the passage connecting the interior of the oil chamber to the outside includes:

a first passage connecting the oil chamber to the communication path chamber, the first passage having a check valve that only permits the fluid to flow from the communication path chamber to the oil chamber; and a second passage connecting the oil chamber to the switch valve line, the second passage including an orifice.

20. The apparatus according to claim 2, wherein the on-off valve has a groove that communicates with the cylinder side through hole when the communication path is shut off, wherein the groove has a first surface and a second surface, the first surface receiving a force that urges the on-off valve in the direction for shutting off the communication path, the second surface receiving a force that urges the on-off valve in the direction for opening the communication path, and wherein a projected area of the first surface onto a plane the normal line of which agrees with the movement direction of the on-off valve is smaller than a projected area of the second surface on the same plane.

* * * * *